US009268272B2

(12) United States Patent
Mukoyama et al.

(10) Patent No.: US 9,268,272 B2
(45) Date of Patent: Feb. 23, 2016

(54) HEAT-GENERATION BELT, FIXING DEVICE, AND IMAGE FORMING APPARATUS

(71) Applicant: Konica Minolta, Inc., Tokyo (JP)

(72) Inventors: Izumi Mukoyama, Tokyo (JP); Eiichi Yoshida, Tokyo (JP); Susumu Sudo, Tokyo (JP); Akira Ohira, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/023,556

(22) Filed: Sep. 11, 2013

(65) Prior Publication Data

US 2014/0079454 A1 Mar. 20, 2014

(30) Foreign Application Priority Data

Sep. 18, 2012 (JP) ..... 2012-204330

(51) Int. Cl.
*G03G 15/20* (2006.01)
*H05B 1/02* (2006.01)
(Continued)

(52) U.S. Cl.
CPC ..... *G03G 15/2057* (2013.01); *G03G 15/2017* (2013.01); *G03G 15/2053* (2013.01); *H05B 1/0241* (2013.01); *H05B 3/0095* (2013.01); *H05B 3/46* (2013.01); *G03G 15/2064* (2013.01); *G03G 2215/2025* (2013.01); *H05B 2203/011* (2013.01)

(58) Field of Classification Search
CPC ..... G03G 15/2017; G03G 15/2053; G03G 15/2057
USPC ..... 399/90, 329
See application file for complete search history.

(56) References Cited

U.S. PATENT DOCUMENTS

| | | | | |
|---|---|---|---|---|
| 5,094,930 | A * | 3/1992 | Nomori et al. | 430/96 |
| 2002/0076540 | A1 * | 6/2002 | Badesha et al. | 428/212 |
| 2003/0049057 | A1 * | 3/2003 | Finn et al. | 399/333 |

(Continued)

FOREIGN PATENT DOCUMENTS

| | | |
|---|---|---|
| JP | 05-081923 | 4/1993 |
| JP | 2005-031301 | 2/2005 |

(Continued)

OTHER PUBLICATIONS

English translation of Japanese Office Action, Notice of Reasons for Rejection, Japanese Patent Application No. 2012-204330, dispatch date: Oct. 21, 2014 (6 pages).

(Continued)

*Primary Examiner* — Benjamin Schmitt
(74) *Attorney, Agent, or Firm* — Lucas & Mercanti, LLP

(57) ABSTRACT

An endless heat-generation belt 10 includes a heat-generation layer 11 and a pair of metal electrodes 12 and 12. The heat-generation layer 11 is composed of an electroconductive resin composition and the heat-generation layer 11 can be heated by supplying electricity. The metal electrode 12 is bonded to the heat-generation layer 11 with an electroconductive adhesive 13. The electroconductive adhesive 13 contains an adhesive matrix and an electroconductive filler. The adhesive matrix is a modified silicone resin or an epoxy resin. The heat-generation belt 10 has excellent heat resistance, durability, and resistance stability, and it can be used for a fixing device of an image forming apparatus.

8 Claims, 8 Drawing Sheets

(51) Int. Cl.
*H05B 3/46* (2006.01)
*H05B 3/00* (2006.01)

(56) References Cited

U.S. PATENT DOCUMENTS

| | | | | |
|---|---|---|---|---|
| 2005/0084690 | A1* | 4/2005 | Matsunaka et al. | 428/447 |
| 2007/0298252 | A1* | 12/2007 | Chen et al. | 428/339 |
| 2008/0124150 | A1* | 5/2008 | Schuman | 399/333 |
| 2011/0129267 | A1* | 6/2011 | Arimoto et al. | 399/329 |
| 2011/0293340 | A1* | 12/2011 | Yamamoto et al. | 399/329 |
| 2012/0051810 | A1* | 3/2012 | Yoshida et al. | 399/333 |

FOREIGN PATENT DOCUMENTS

| | | |
|---|---|---|
| JP | 2008-170715 | 7/2008 |
| JP | 2008-231735 | 10/2008 |
| JP | 2009-109997 A | 5/2009 |
| JP | 2012-008299 | 1/2012 |
| JP | 2012-177790 | 9/2012 |
| JP | 2003-005538 | 1/2013 |
| WO | 2012/057281 | 5/2012 |

OTHER PUBLICATIONS

Japanese Office Action, Notice of Reasons for Rejection, Japanese Patent Application No. 2012-204330, dispatch date: Oct. 21, 2014 (4 pages).

Office Action dated May 26, 2015 issued from the corresponding Japanese Patent Application No. 2012-204330.

English translation of Office Action dated May 26, 2015 issued from the corresponding Japanese Patent Application No. 2012-204330.

* cited by examiner

HEAT-GENERATION BELT, FIXING DEVICE, AND IMAGE FORMING APPARATUS

CROSS REFERENCE TO RELATED APPLICATIONS

This application is entitled to and claims the benefit of Japanese Patent Application No. 2012-204330 filed on Sep. 18, 2012, the disclosure of which including the specification, drawings and abstract is incorporated herein by reference in its entirety.

BACKGROUND OF THE INVENTION

1. Field of the Invention

The present invention relates to a heat-generation belt, and a fixing device and an image forming apparatus including therein the heat-generation belt.

2. Description of Related Art

Electrophotographic image forming apparatus have been widely used, with laser beam printers, facsimile machines, copiers, digital multifunctional peripherals and the like being generally known. The image forming apparatus are equipped with a fixing device configured to fix a non-fixed toner image on a toner receiving article.

A known example of such a fixing device is, for example, a fixing device that includes: an endless heat-generation belt, an elastic roll provided on the inner side of the heat-generation belt, a pressure roll for pressing the elastic roll with the intervening heat-generation belt from the exterior of the heat-generation belt, and a power supply for supplying electricity to a resistance heating layer of the heat-generation belt. The fixing device conducts fixing of a toner image by melting the toner image onto the toner receiving article. The resistance heating layer is provided on each of its opposite edges with an annular electrode layer to which electricity is supplied from the power supply. The electrode layer is bonded, for example, to the resistance heating layer (see, for example, Japanese Patent Application Laid-Open No. 2009-109997).

Adequate and stable adhesion strength is required for a long period with regard to the adhesion between the resistance heating layer and the electrode layer. The resistance heating layer is typically composed of a polyimide which can adhere to metals. Adhesion of polyimides to metals, however, is weak.

An exemplary countermeasure for improving the adhesion strength between the resistance heating layer and the electrode layer involves adhesion of the electrode layer to the resistance heating layer by means of chemical bonding, and more specifically, by using a silane coupling agent. Silane coupling agents, however, are readily soluble in a varnish of polyamic acid, a precursor composition for a polyimide. In addition, silane coupling agents are sometimes decomposed at temperatures at which imidation of polyamic acid is effected (for example, 450° C.). Accordingly, adhesion of the electrode layer to the resistance heating layer using a silane coupling agent may lead to generation of some non-bonded parts resulting the heat-generation belt exhibiting unstable resistance heating.

SUMMARY OF THE INVENTION

An object of the present invention is to provide a heat-generation belt having excellent heat resistance, durability, and resistance stability.

Another object of the present invention is to provide a fixing device and an image forming apparatus having such a heat-generation belt.

To achieve at least one of the above-mentioned objects, an endless heat-generation belt reflecting one aspect of the present invention comprises 1) a heat-generation layer composed of an electroconductive resin composition which generates heat when electricity is supplied to the electroconductive resin composition, and 2) a pair of metal electrodes bonded to the heat-generation layer with an electroconductive adhesive. The electroconductive adhesive contains an adhesive matrix and an electroconductive filler, and the adhesive matrix is a modified silicone resin or an epoxy resin.

A fixing device reflecting one aspect of the present invention comprises the foregoing heat-generation belt, a fixing roller provided on an inner side of the heat-generation belt, the fixing roller being in contact with an inner circumferential surface of the heat-generation belt at one circumferential portion of the heat-generation belt, a pressing roller disposed to face the fixing roller across the heat-generation belt, the pressing roller being configured to push an outer circumferential surface of the heat-generation belt toward the fixing roller at a circumferential surface of the pressing roller, and a power supply device configured to supply electricity to the heat-generation belt.

An image forming apparatus reflecting one aspect of the present invention comprises the foregoing fixing device for fixing a non-fixed toner image electrophotographically formed on a toner receiving article to the toner receiving article through the application of heat and pressure.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Next, embodiments of the present invention are described in detail with reference to the accompanying drawings.

(Heat-Generation Belt)

Figure 1A:
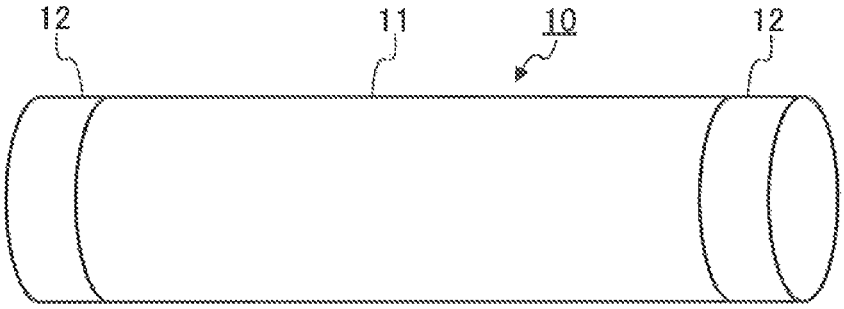
FIG. 1A illustrates an outer side of a heat-generation belt according to an embodiment of the present invention.
Figure 1B:
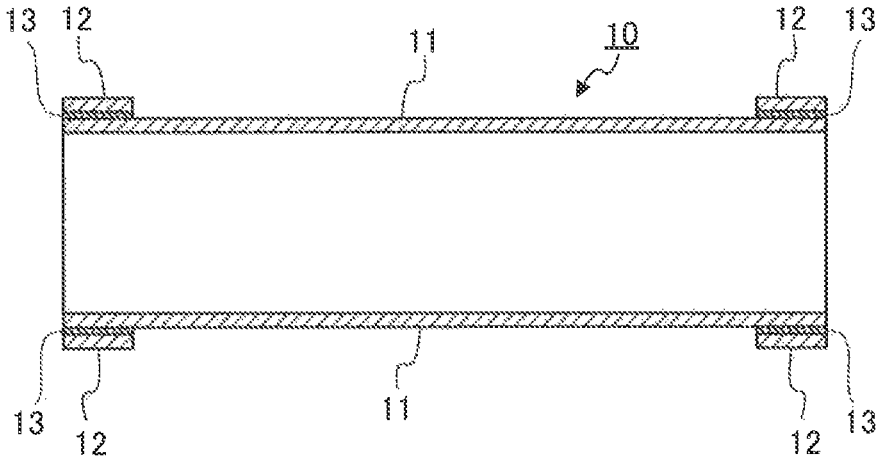
FIG. 1B is a cross-sectional view of the heat-generation belt of FIG. 1A taken along the axial plane.

FIGS. 1A and 1B are schematic views of a heat-generation belt 10 according to an embodiment of the present invention. FIG. 1A illustrates an outer side of the heat-generation belt 10. FIG. 1B is a cross sectional view of the heat-generation belt 10 of FIG. 1A taken along the axial plane.

The heat-generation belt 10 is endless (tubular). The heat-generation belt 10 has a heat-generation layer 11 and a metal electrode 12. The metal electrode 12 is bonded to the heat-generation layer 11 with an electroconductive adhesive 13.

The heat-generation layer 11 is heated by electricity supplied thereto. The heat-generation layer 11 is composed of an electroconductive resin composition. The electroconductive resin composition is for example a composition containing a resin and an electroconductive material.

The resin preferably exhibits superior heat resistance, and preferably exhibits flexibility. Examples of the resin include polyphenylene sulfide (PPS), polyallylate (PAR), polysulfone (PSF), polyether sulfone (PES), polyetherimide (PEI), polyimide (PI), polyamideimide (PAI), polyether ether ketone (PEEK), derivatives thereof, and resins produced by modifying the foregoing resins, with polyimide and polyamideimide being most preferable.

The electroconductive material can be a powder of any of the electroconductive materials known in the art. Examples of the electroconductive material include metals such as silver, copper, aluminum, magnesium, nickel, and stainless steel; carbon compounds such as graphite, carbon black, carbon nanofiber, and carbon nanotube; and ionic electroconductors such as silver iodide and copper iodide.

The electroconductive material preferably has a size of 10 to 300 μm (length of the longest part) from the perspective of providing the heat-generation layer 11 with predetermined electroconductivity. The electroconductive material is preferably fibrous from the perspective of increasing the contact points between strands of the electroconductive material in the heat-generation layer 11.

When the electroconductive material is made of the same material as the metal electrode 12, difference in electrical potential between the metal electrode 12 and the heat-generation layer 11 will be reduced.

The heat-generation layer 11 may be prepared by applying a coating solution for the heat-generation layer over the circumferential surface of a columnar support by a method known in the art. The coating solution for the heat-generation layer is for example a composition containing the resin composition described above or a solution thereof, or a precursor of the resin of the resin composition or a solution thereof, and the electroconductive material described above. The resin precursor is, for example, polyamic acid.

The heat-generation layer 11 preferably has a thickness of 50 to 200 μm from the perspective of enabling the predetermined heat generation. The heat-generation layer 11 may be adjusted, for example, by means of the viscosity of the coating solution for the heat-generation layer, or the number of the times the coating solution for the heat-generation layer is applied.

The heat-generation layer 11 preferably has a volume resistivity of $1.0\times10^{-6}$ to $9.9\times10^{-3}$ Ωm from the perspective of realizing a predetermined amount of heat generation (electroconductivity). The volume resistivity may be adjusted for example by the amount of the electroconductive material in the resin composition or by the thickness of the heat-generation layer 11.

The resin composition may further contain additives as long as the advantages of the present invention are realized. For example, when polyamic acid is heated to a temperature of about 200 to about 450° C., the polyamic acid is converted to polyimide by imidation, and the imidation can be promoted at lower temperatures when a catalyst or a dehydrator is used. The catalyst is not particularly limited, as long as it promotes imidation, and examples of the catalyst include imidazoles, secondary amines, and tertiary amines. Examples of the dehydrator include organic carboxylic acid anhydrides, N,N'-dialkyl carbodiimides, lower fatty acid halides, halogenated lower fatty acid anhydrides, aryl phosphonic dihalides, and thionyl halides.

The metal electrode 12 is an annular electrode for supplying electricity to the heat-generation layer 11. The metal electrodes 12 and 12 are placed at opposite edges of the outer circumferential surface of the heat-generation layer 11. The metal electrodes 12 and 12 are respectively placed so that they fully surround the outer circumferential surface of the heat-generation layer 11.

The metal electrode 12 may be prepared using a common metal used as electrode material. Examples of the material used for the metal electrode 12 include copper, aluminum, nickel, brass, phosphor bronze, stainless steel, and iron chromium. A metal electrode 12 made of stainless steel, nickel or iron chromium is preferable since these materials are less susceptible to oxidation, and hence, change in the resistance is small.

The width of the metal electrode 12 is determined from the perspective of sufficiently increasing the contact area between the heat-generation layer 11 and the metal electrode 12 and the contact area between a power supply device and the metal electrode 12. Accordingly, the metal electrode 12 preferably has a width of 5 to 30 mm. The thickness of the metal electrode 12 is determined for simultaneous pursuit of appropriate strength and softness. The metal electrode 12 preferably has a thickness of 10 to 100 μm, and more preferably 30 to 60 μm from the perspective of the balance between rigidity and softness of the metal electrode 12.

An electroconductive adhesive 13 contains an adhesive matrix and an electroconductive filler.

The adhesive matrix is a resin which develops adhesion; the adhesive matrix contains a modified silicone resin or an epoxy resin. The resin provides superior adhesion between the resin constituting the heat-generation layer 11 and the metal electrodes 12.

The modified silicone resin is suitable to form a flexible adhesive layer. Examples of the modified silicone resin include crosslinkable silyl group-containing organic polymers and crosslinkable silyl group-containing acryl polymers.

Examples of the crosslinkable silyl group-containing organic polymers include polyoxyalkylene polymers, vinyl-modified polyoxyalkylene polymers, vinyl polymers, polyester polymers, acrylate polymers, and methacrylate polymers, which contain at least one crosslinkable silyl group in the molecule; copolymers of such polymers; and mixtures containing the copolymer(s) as the main component. The main chain of the polymer may have an organosiloxane.

The crosslinkable silyl group-containing acryl polymer refers to a polymer having at least one crosslinkable silyl group in the molecule; examples thereof include polymers whose main chain is essentially formed by (co)polymerization of one or more different acryl monomers, and mixtures containing the polymer(s) as the main component. The main chain of the polymer may include an organosiloxane. Examples of the acryl monomers include (meth)acrylic acid, (meth)acrylate, (meth)acrylonitrile, and (meth)acrylamide.

The crosslinkable silyl group-containing organic polymer and the crosslinkable silyl group-containing acryl polymer each preferably have a number-average molecular weight of 1,000 or more, and more preferably, 6,000 to 30,000. In addition, the polymers further preferably have a narrow molecular weight distribution. The number of crosslinkable silyl groups in one molecule of the polymer is preferably 1 to 5.

The epoxy resin is generally suitable for the formation of a hard adhesive layer. Examples of the epoxy resin include bisphenol epoxy resins such as bisphenol A epoxy resin, bisphenol F epoxy resin, and bisphenol S epoxy resin; novolac epoxy resins such as phenol novolac epoxy resin and alkylphenol novolac epoxy resin; glycidylamine epoxy resins; biphenol epoxy resins; naphthalene epoxy resins; dicyclopentadiene epoxy resins; epoxydated compounds derived from condensates of phenol and phenolic hydroxy group-containing aromatic aldehydes, and bromine atom-containing epoxy resins and phosphorus atom-containing epoxy resins of the epoxydated compounds; heterocyclic epoxy resins such as triglycidyl isocyanurate; and alicyclic epoxy resins.

The amount of the adhesive matrix in the electroconductive adhesive is preferably 10 to 30% by weight from the perspective of providing a predetermined level of adhesion.

The electroconductive filler constitutes the electroconductive pathway in the electroconductive adhesive. The electroconductive filler preferably has a size of 1 to 50 μm (length of the longest part) from the perspective of providing the electroconductive adhesive with a predetermined level of electroconductivity. The electroconductive filler is preferably fibrous from the perspective of increasing the contact points between strands of the electroconductive filler in the electroconductive adhesive.

The material used for the electroconductive filler include those described above for the electroconductive material.

The material of the electroconductive filler is preferably silver because of its stability against corrosion. The material of the electroconductive filler is preferably nickel because of its general superior adhesion to acrylic resins. The material of the electroconductive filler is preferably stainless steel because of its rust resistance and commercial availability.

The amount of the electroconductive filler in the electroconductive adhesive is determined from the perspective of realizing a predetermined level of electroconductivity. Preferably, the electroconductive filler is used in an amount such that the electroconductive adhesive has, for example, a volume resistivity of predetermined level, e.g., $1.0\times10^{-6}$ to $1.0\times10^{-3}$ Ωm, a level that is conceived preferable for electroconductive adhesives. The amount of the electroconductive filler in the electroconductive adhesive is typically about 80% by volume.

The electroconductive adhesive may further contain additives as long as the advantages of the present invention are realized. Examples of the additives for the electroconductive adhesive include organic solvents and polymer powders known in the art. The polymer powders used depend on the type of the adhesive matrix; for example, the polymer powders may be added when the adhesive matrix is a modified silicone resin.

Examples of the polymer powders include polymer powders containing methyl methacrylate as its monomer unit, and more specifically, acryl polymer powder and vinyl polymer powder.

The amount of the polymer powder in the electroconductive adhesive is preferably 2 to 300 parts by weight per 100 parts by weight of the adhesive matrix from the perspective of providing a predetermined level of adhesion.

The electroconductive adhesive is prepared by mixing together the adhesive matrix, the electroconductive filler, and optionally the additives for the electroconductive adhesive. Alternatively, the electroconductive adhesive may be prepared by adding the electroconductive filler to the resin composition for the adhesive containing the adhesive matrix and the additives for the electroconductive adhesive. A commercially available product may be used as the resin composition for the adhesive.

Figure 2:
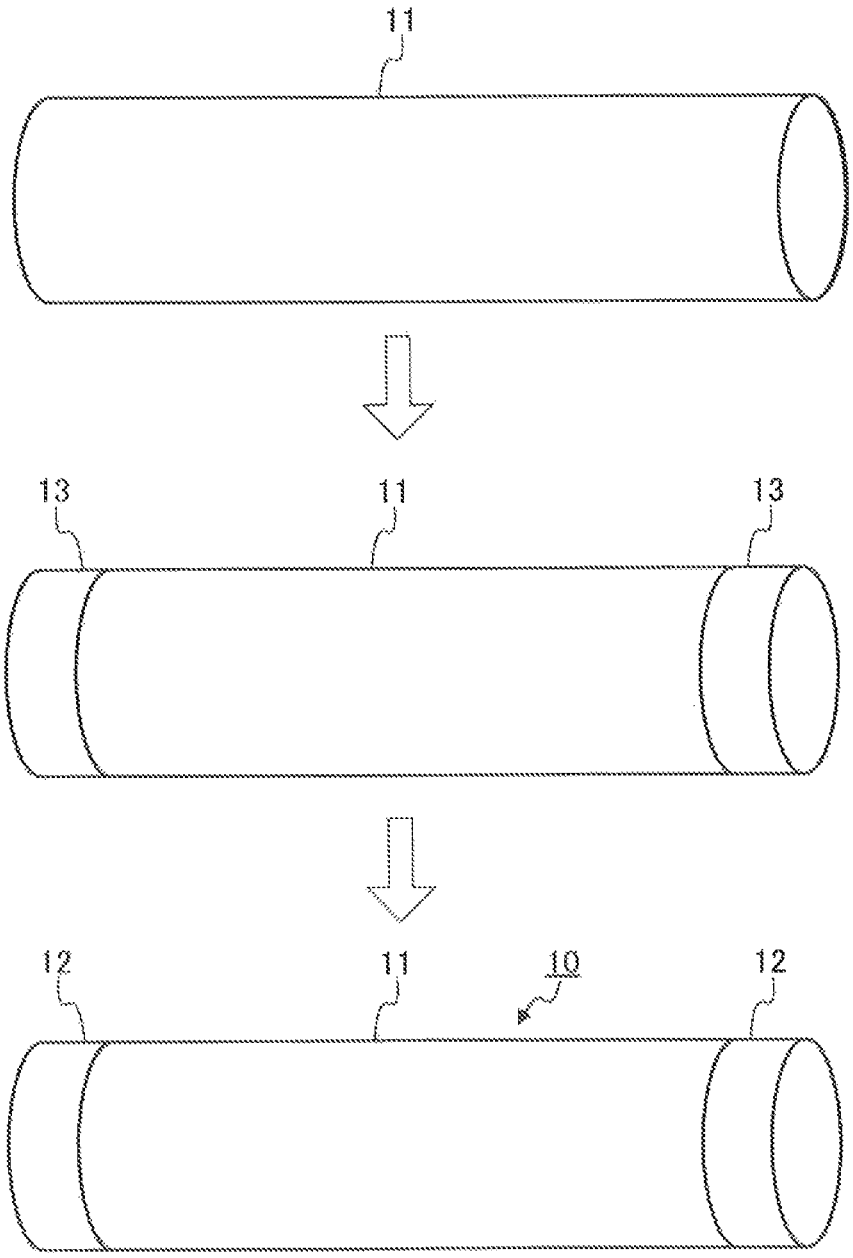
FIG. 2 illustrates a production process of the heat-generation belt according to an embodiment of the present invention.

The heat-generation belt 10 is prepared as shown in FIG. 2. More specifically, the heat-generation belt 10 is prepared by providing the endless heat-generation layer 11; applying the electroconductive adhesive 13 on opposite edges of the heat-generation layer 11; fitting belt-shaped or annular metal electrodes 12 at opposite edges of the heat-generation layer 11 with the electroconductive adhesive 13; and adhering the metal electrodes 12 to the heat-generation layer 11 with the electroconductive adhesive 13 to thereby produce the heat-generation belt 10. The metal electrode 12 and the heat-generation layer 11 may be bonded under the conditions appropriately determined depending on the electroconductive adhesive 13 used.

Figure 3:
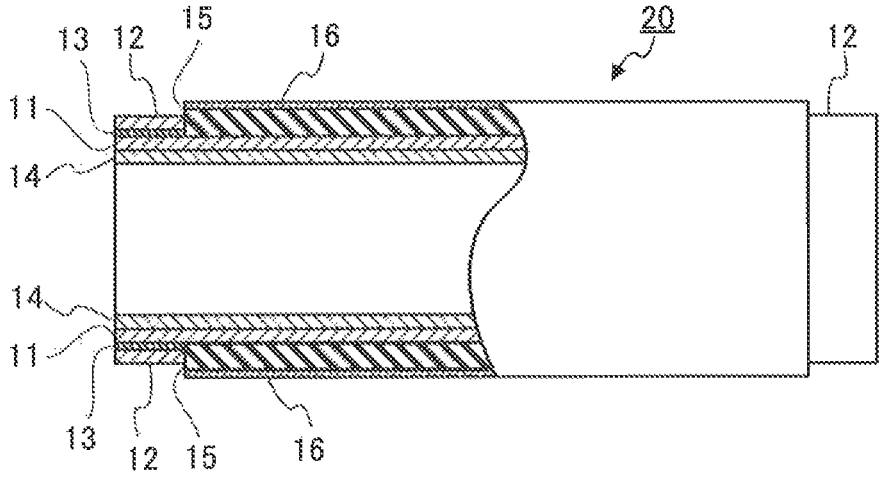
FIG. 3 is a partially cutaway cross-sectional view illustrating the essential part of the heat-generation belt according to another embodiment of the present invention.

The heat-generation belt according to the present invention may have additional layers as with the heat-generation belt 20 shown in FIG. 3.

As shown in FIG. 3, the heat-generation belt 20 includes the heat-generation layer 11, the metal electrodes 12, 12, the electroconductive adhesive 13, and also, a reinforcing layer 14, an elastic layer 15, and a release layer 16.

The reinforcing layer 14 may be formed on the inner side of the heat-generation layer 11. The reinforcing layer 14 may be formed from a heat resistant resin, and the material used for the reinforcing layer 14 is, for example, a polyimide. Exemplary materials used for the reinforcing layer 14 other than polyamide include polyphenylene sulfide (PPS), polyallylate (PAR), polysulfone (PSF), polyether sulfone (PES), polyetherimide (PEI), polyamideimide (PAI), and polyether ether ketone (PEEK). The reinforcing layer 14 preferably has a thickness of, for example, about 100 μm.

The reinforcing layer 14 is preferably in contact with the heat-generation layer 11. In this case, the resin material used for the reinforcing layer 14 preferably contains the resin material for the heat-generation layer 11 from the perspective of improving the adhesion between the reinforcing layer 14 and heat-generation layer 11. It is to be noted that the reinforcing layer 14 may be formed either on the inner or outer side of the heat-generation layer 11. The reinforcing layer 14 may be formed on some areas of the heat-generation layer 11. For example, the reinforcing layer 14 may be formed only in an area where the metal electrode 12 becomes in contact with the heat-generation layer 11 or its surrounding area.

The elastic layer 15 may be formed on the outer side of the heat-generation layer 11 at a position between the metal electrodes 12, 12. The elastic layer 15 is formed from a material having both elasticity and heat resistance, such as a silicone rubber. Exemplary materials used for the elastic layer 15 other than the silicone rubber include fluororubbers, and the elastic layer 15 is preferably formed to a thickness of, for example, 50 to 500 μm.

The release layer 16 may be formed on the outer side of the elastic layer 15. The release layer 16 is formed from a material having releasability. Exemplary materials used for the release layer 16 include fluororesins such as polytetrafluoroethylene (tetrafluoro) resin (PTFE), polytetrafluoroethylene (PFA), and tetrafluoroethylene-ethylene copolymerization resin (ETFE). The release layer 16 may preferably have a thickness of, for example, 5 to 30 μm.

The heat-generation belt 20 may be prepared by a method including, for example, the steps: forming the reinforcing layer 14 on the circumferential surface of a cylindrical support; forming the heat-generation layer 11 on the reinforcing layer 14; forming the elastic layer 15 on the heat-generation layer 11 except for the opposite edges of the heat-generation layer 11; forming the release layer 16 on the elastic layer 15; applying the electroconductive adhesive 13 on the surface of the opposite edges of the heat-generation layer 11; and adhering the metal electrodes 12 on the opposite edges of the heat-generation layer 11 with the electroconductive adhesive 13.

The step of forming the elastic layer 15 may be conducted either before or after the step of applying the electroconductive adhesive 13.

The reinforcing layer 14, the elastic layer 15, and the release layer 16 may be formed by applying coating solutions for the reinforcing layer, elastic layer, and release layer, respectively, and curing the coatings. Each of the coating solutions may be prepared for example by mixing together the resin constituting the corresponding layer or the precursor thereof, and where necessary, optional additives such as foaming agents and/or organic solvents.

A resistance change of the heat-generation belt used in the present invention is preferably up to 2%, and more preferably up to 1%. The resistance change is found as % change in resistance between the metal electrodes before the after repeated heat generation when the heat-generation belt is repeatedly allowed to generate heat. The term "repeated heat generation" of the heat-generation belt means that the heat-generation belt is repeatedly allowed to generate heat so that the temperature at the surface of the heat-generation belt reaches a predetermined temperature by intermittently supplying electricity to the heat-generation belt.

The resistance change of the heat-generation belt may be determined by a durability test corresponding to the intended application of the heat-generation belt. For example, when the heat-generation belt is to be used as a fixing belt of an image forming apparatus, the heat-generation belt is repeatedly allowed to generate heat having a temperature for fixing, and the resistance between the metal electrodes of the heat-generation belt before and the after the repeated heat generation is measured to find the resistance change.

Use of the heat-generation belt with a resistance change of up to 2% means that a change in heat generation (surface temperature) associated with the operation of the heat-generation belt is limited; for example, when the heat-generation belt is used as a fixing belt, such an amount of the resistance change is preferable from the perspective of maintaining the quality of the image formed in the image forming apparatus at a predetermined level. The above-described amount of the resistance change may be realized for example by means of the type and/or composition of the adhesive matrix that forms the adhesive layer having physical properties suited to the intended application of the heat-generation belt.

In the heat-generation belt according to this embodiment, the heat-generation layer and the metal electrodes are bonded together with an electroconductive adhesive containing a modified silicone resin or an epoxy resin as the adhesive matrix. Since the electroconductive adhesive has sufficient adhesion as well as high heat resistance, partial peeling between the heat-generation layer and the metal electrode does not occur even by the repeated cycle of heat generation and cooling of the heat-generation belt or by the driving of the belt to rotate. Accordingly, electric resistance between the metal electrodes is stable for a prolonged time.

In the case of the heat-generation belt according to this embodiment, a flexible adhesive layer can be obtained by using a modified silicone resin for the adhesive matrix and also using a polymer powder. Accordingly, peeling between the heat-generation layer and metal electrode is less likely to occur, and such a constitution is effective from the perspective of high long-term stability of the electric resistance between the metal electrodes.

The heat-generation belt according to an embodiment of the present invention is used in applications where in-plane heat generation is used. For example, the heat-generation belt is preferably used as a heat-generation belt in the fixing device of an image forming apparatus as shown in FIG. 4.

Figure 4A:
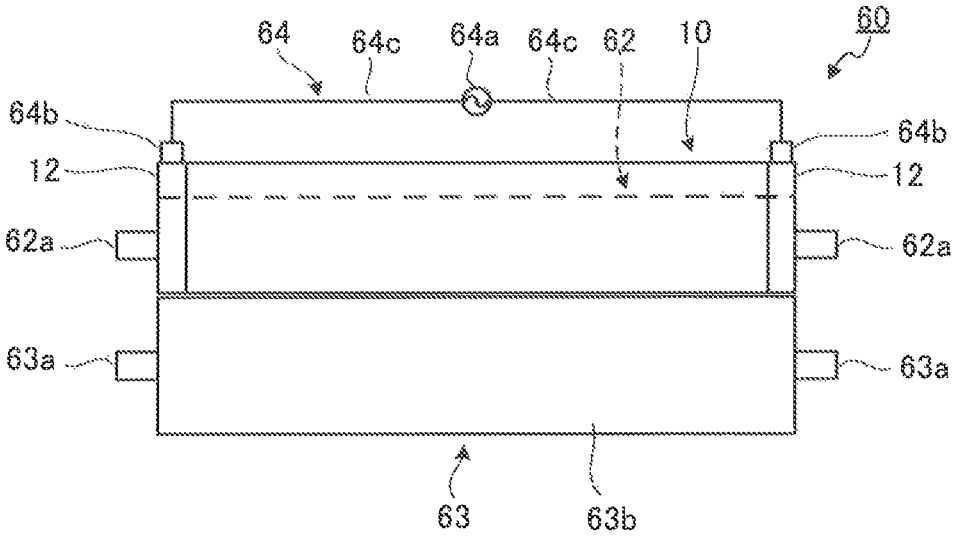
FIG. 4A is a front elevational view of a fixing device according to an embodiment of the present invention taken along the direction of conveying the toner receiving article.
Figure 4B:
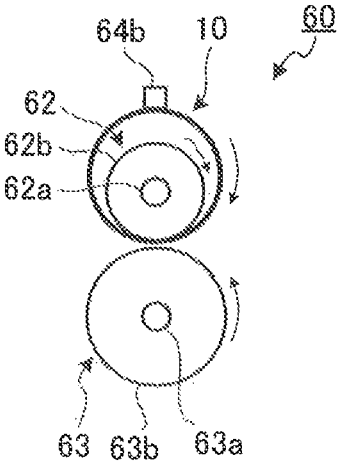
FIG. 4B is a side elevational view of the same fixing device.

FIG. 4 is a schematic view of a fixing device 60 according to an embodiment of the present invention. FIG. 4A is a front elevational view of a fixing device taken along the direction of transporting the toner receiving article, and FIG. 4B is a side elevational view of the same fixing device.

The fixing device 60 has the heat-generation belt 10, a fixing roller 62, a pressing roller 63, and a power supply device 64 as shown in FIG. 4. The heat-generation belt 10 is the one shown in FIG. 1. The heat-generation belt 10 may be the heat-generation belt 20 shown in FIG. 3.

The fixing roller 62 includes a columnar mandrel 62*a* and a resin layer 62*b* disposed on the circumferential surface of the columnar mandrel 62*a*. The resin layer 62*b* has an outer diameter smaller than the inner diameter of the heat-generation belt 10, and the fixing roller 62 is placed on the inner side of the heat-generation belt 10. The fixing roller 62 is in contact with the inner circumferential surface of the heat-generation belt 10 at one circumferential section of the heat-generation belt.

The pressing roller 63 has a columnar mandrel 63*a* and a resin layer 63*b* on the circumferential surface of the columnar mandrel 63*a*. The pressing roller 63 faces the fixing roller 62 across the heat-generation belt 10. The pressing roller 63 is arranged so that it can press the outer circumferential surface of the heat-generation belt 10 toward the fixing roller 62. The pressing roller 63 is typically spaced from the heat-generation belt 10.

The resin layers 62*b* and 63*b* are, for example, resin layers of a known resin or foamed resin layers prepared by foaming a known resin. Examples of such resins include silicone rubbers and fluororubbers, and at least one of the resin layers 62*b* and 63*b* should be elastic enough to be deformed by the pressing by the pressing roller 63.

The pressing roller 63 may further include a release layer which has releasability from a toner receiving article, and the release layer may be disposed on the resin layer 63*b*. The release layer may be composed of a fluororesin tube or a fluororesin coating. The release layer may be formed from the fluororesin described above, and the release layer may preferably have a thickness of, for example, 5 to 100 μm.

The power supply device 64 has an AC power source 64*a*, a power supply member 64*b* in contact with the metal electrodes 12, and a lead wire 64*c* that connects the AC power source 64*a* to the power supply member 64*b*. The power supply member 64*b* is biased by an elastic member (not shown) such as a leaf spring or a coil spring toward the metal electrodes 12. The power supply member 64*b* may be a member which comes in either sliding or rotational contact with the metal electrodes 12. The power supply member 64*b* may be, for example, a carbon brush composed of a carbon material such as graphite or a copper-graphite composite material.

The heat-generation belt 10, the fixing roller 62, and the pressing roller 63 are rotatable. These members may be rotatable either independently, or one member may be rotatable, the other two following the rotatable one member.

Figure 5A:
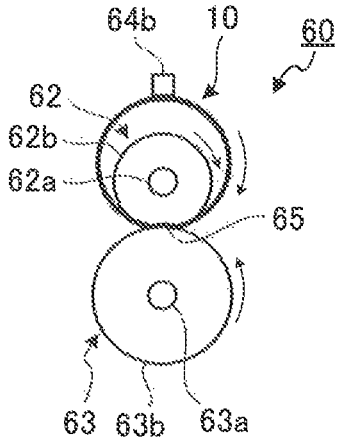
FIG. 5A illustrates a case wherein a nip is formed by the deformation of the fixing roller in the fixing device according to an embodiment of the present invention.
Figure 5B:
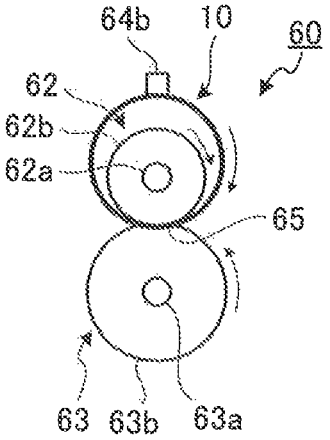
FIG. 5B illustrates a case wherein a nip is formed by the deformation of the pressing roller in the same fixing device.

When the pressing roller 63 pushes the outer circumferential surface of the heat-generation belt 10 toward the fixing roller 62, a contact area (nip) 65 is formed between the heat-generation belt 10 and the pressing roller 63 as shown in FIGS. 5A and 5B. FIG. 5A illustrates a nip formed by the deformation of the fixing roller 62, and FIG. 5B illustrates a nip formed by the deformation of the pressing roller 63.

The nip 65 may be formed by the deformation (recess formation) of the fixing roller 62 as shown in FIG. 5A. In case where a nip is formed by the deformation of the fixing roller 62, an electroconductive adhesive 13 prepared by using a modified silicone resin for the adhesive matrix may be used since the electroconductive adhesive 13 is flexible.

The nip 65 may also be formed by the deformation (recess formation) of the pressing roller 63 as shown in FIG. 5B. In case where a nip is formed by the deformation of the pressing roller 63, an electroconductive adhesive 13 containing as the adhesive matrix an epoxy resin may be used, since the electroconductive adhesive 13 is hard after curing.

Upon fixing of a toner image, rotation of the rollers and the heat-generation belt 10, supply of electricity to the heat-generation belt 10, and formation of the nip 65 are performed by the same procedure as that for the known fixing device. In addition, the fixing device 60 may further include other components of the known fixing device.

The fixing device according to an embodiment of the present invention includes the heat-generation belt described above as a heater for fusing toner onto a toner receiving article. The heat-generation belt according to an embodiment of the present invention has high heat resistance, long-term stability of the electric resistance between the metal electrodes, and long-term adhesion stability between the metal electrodes and the heat-generation belt. In addition, the electrodes are highly durable since they are metal electrodes. Accordingly, the embodiment provides a fixing device which has enabled long-term constant heat generation.

Provision of other layers such as an elastic layer 15 and a release layer 16 with the heat-generation belt is effective from the perspective of realizing sufficient close contact of the heat-generation belt to the toner receiving article at the nip, and prevention of the attachment of the toner or other contaminant on the surface of the heat-generation belt.

Furthermore, the heat-generation belt prepared by using the modified silicone resin as the adhesive matrix is suitable for use in a fixing device wherein the nip is formed by the deformation of the fixing roller, since the adhesive layer between the metal electrode and heat-generation layer is flexible. On the other hand, the heat-generation belt prepared by using the epoxy resin as the adhesive matrix is suitable for use in a fixing device wherein the nip is formed by the deformation of the pressing roller.

The image forming apparatus according to an embodiment of the present invention may be configured in the same manner as the common image forming apparatus except that the apparatus has the fixing device according to an embodiment of the present invention.

Figure 6:
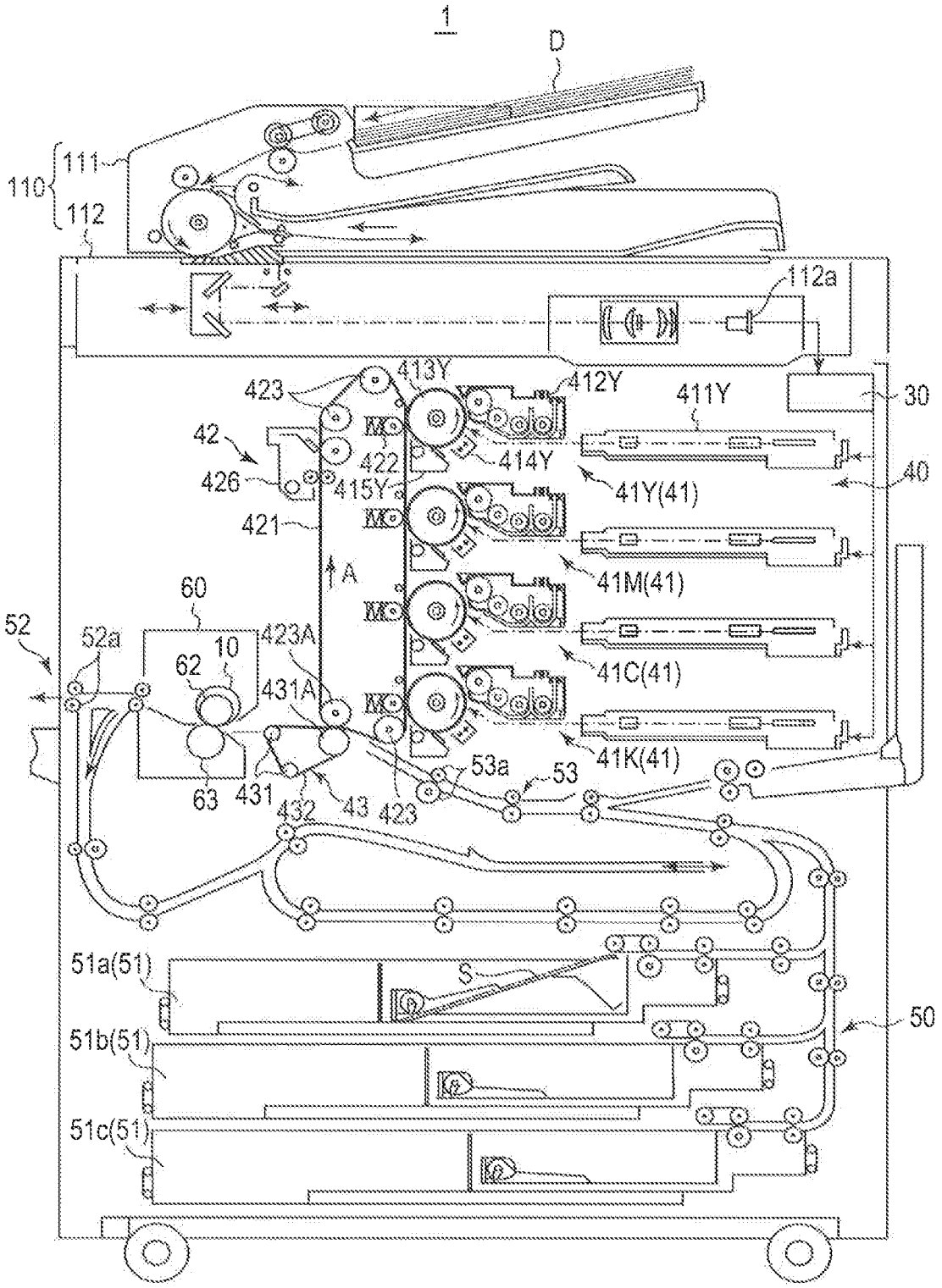
FIG. 6 is a schematic view illustrating an image forming apparatus according to an embodiment of the present invention.

FIG. 6 is a schematic view showing the image forming apparatus according to an embodiment of the present invention. The image forming apparatus shown in FIG. 6 is an electrophotographic color image forming apparatus using the intermediate transfer mode.

As shown in FIG. 6, the image forming apparatus 1 has an image reading section 110, an image processing section 30, an image forming section 40, a sheet conveying section 50, and a fixing device 60. The fixing device 60 is, for example, the fixing device shown in FIGS. 4 and 5.

The image reading section 110 includes an automatic document feeding device 111 called ADF (auto document feeder), a document image scanning device 112 (scanner), and the like.

The document D placed on the document tray is conveyed to the document image scanning device 112 by the automatic document feeding device 111. The automatic document feeding device 111 reads the image of the document D as the document D is conveyed. The document image scanner 112 reads the document D on the contact glass by optical scanning. The light reflected from the document D is read by a CCD (charge coupled device) sensor 112*a*, and an input image data is thereby produced.

The input image data is subjected to predetermined image processing in the image processing section 30, and the image forming section 40 is controlled based on the processed data.

The image forming section 40 includes image forming units 41Y, 41M, 41C, and 41K, an intermediate transfer unit 42, a secondary transfer unit 43, and the like. The image forming units 41Y, 41M, 41C, and 41K respectively form images using Y (yellow), M (magenta), C (cyan), and K (black) toners based on the input image data.

The image forming units 41Y, 41M, 41C, and 41K have similar constitution. For convenience of drawing and explanation, only image forming unit 41Y for Y component is described with reference numerals, and explanation with numerals is omitted for the other image forming units 41M, 41C, and 41K.

The image forming unit 41 has an exposing device 411, a developing device 412, a photoconductor drum (image bearing member) 413, a charger 414, a drum cleaning device 415, and the like.

The photoconductor drum 413 is, for example, a negative charge-type organic photoreceptor. The surface of the photoconductor drum 413 has photoconductivity. The photoconductor drum 413 rotates at a constant circumferential velocity.

The charger 414 is, for example, a corona unit. Negative charge from the charger 414 is evenly distributed over the surface of the photoconductor drum 413.

The exposing device 411 is composed of, for example, a semiconductor laser. The exposing device 411 emits a laser corresponding to the image of each color component to the photoconductor drum 413 to thereby form an electrostatic latent image on the surface of the photoconductor drum 413.

The developing device 412 is, for example, a developing device of two component developing system. The electrostatic latent image is visualized by the attachment of the toner on the surface of the photoconductor drum 413, and a toner image corresponding to the electrostatic latent image is thereby formed on the surface of the photoconductor drum 413. The term "toner image" refers to toner particles accumulated to form an image.

The toner image on the surface of the photoconductor drum 413 is transferred to an intermediate transfer belt 421 by the intermediate transfer unit 42. The toner remaining on the surface of the photoconductor drum 413 after the transfer is removed by a drum cleaning device 415 having a drum cleaning blade that comes in sliding contact with the surface of the photoconductor drum 413.

The intermediate transfer unit 42 has an intermediate transfer belt 421 to which the toner image is intermediately transferred, a primary transfer roller 422 which presses the intermediate transfer belt 421 to the photoconductor drum 413, supporting rollers 423 including back up roller 423A, and a belt cleaning device 426. The intermediate transfer belt 421 is an endless belt.

The intermediate transfer belt 421 is retained in the form of loop by a plurality of supporting rollers 423. The intermediate transfer belt 421 moves in the direction of Arrow A at a constant speed by the rotation of at least one driving roller of the supporting rollers 423. The primary transfer roller 422 presses the intermediate transfer belt 421 to the photoconductor drum 413, and the toner images of different colors are overlaid one on another on the intermediate transfer belt 421.

The secondary transfer unit 43 has an endless secondary transfer belt 432 and a plurality of supporting rollers 431 including a secondary transfer roller 431A.

The secondary transfer belt 432 is retained in the form of loop by the secondary transfer roller 431A and the supporting rollers 431. The secondary transfer roller 431A is pressed against the backup roller 423A by the intervening intermediate transfer belt 421 and secondary transfer belt 432, thereby forming a transfer nip. The sheet S which is the toner receiving article passes through the transfer nip.

The sheet S is conveyed by a sheet conveying section 50 to the transfer nip. The sheet conveying section 50 has a sheet feeding section 51, a sheet discharging section 52, a conveying path section 53, and the like. Sheets S (standardized paper or special paper) differentiated by basis weight, size, and the like are accommodated in three sheet feed tray units 51*a* to 51*c* constituting the sheet feeding section 51.

The conveying path section 53 has a plurality of conveyance roller pairs including registration roller pair 53*a*. Leaning of the sheet S is corrected and the timing of the conveying is adjusted in registration roller section where the registration roller pair 53*a* is provided.

When the sheet S is conveyed to the transfer nip, transfer bias is applied to the secondary transfer roller 431A. The toner image on the intermediate transfer belt 421 is transferred to the sheet S by this application of the transfer bias. The sheet S having the transferred toner image thereon is conveyed toward the fixing device 60 by the secondary transfer belt 432.

The fixing device 60 applies heat and pressure to the thus conveyed sheet S at the nip, and the toner image is thereby fixed on the sheet S. The sheet S having the toner image fixed thereon is discharged to the outside of the apparatus from the sheet discharging section 52 having a sheet discharging roller 52*a*.

The toner remaining on the surface of the intermediate transfer belt 421 is removed by a belt cleaning device 426 having a belt cleaning blade in sliding contact with the surface of the intermediate transfer belt 421.

The image forming apparatus according to this embodiment of the present invention has the above-described heat-generation belt with highly stable electric resistance, high heat resistance, and adhesion durability described above as the heating section of the fixing device, and therefore, changes in the quality of the fixed image by the change in the fixing temperature are prevented, and high quality images can be formed for a prolonged period.

In addition, the heat-generation belt can be heated faster than the heating section in the form of a roller. Accordingly, in the image forming apparatus according to this embodiment of the present invention, the electricity consumed for heating the heating section can be reduced compared with the image forming apparatus provided with the roller fixing device in the heating section.

As demonstrated by the foregoing explanation, this embodiment is capable of providing a heat-generation belt having improved heat resistance, durability, and resistance stability, and a fixing device and an image forming apparatus having this heat-generation belt.

EXAMPLES

[Preparation of Heat-generation Layer]

39 g of stainless steel fiber ("SMF300" manufactured by JFE Techno-Research Corporation) was added to 100 g of a solution of polyamic acid which is a polyimide precursor ("U-varnish S301" manufactured by Ube Industries). Next, the mixture was stirred and mixed in TK Homodisper model 2.5 manufactured by PRIMIX Coporation at 2,000 rpm for 15 minutes to prepare a coating solution for the heat-generation layer.

The coating solution for the heat-generation layer was applied on the outer circumferential surface of a stainless steel mandrel having a length of 380 mm and an outer diameter of 30.0 mm to form a coating film having a thickness of 800 μm. The mandrel and the coating film were then heated at 120° C. for 40 minutes while rotating the mandrel at a rotation speed of 40 rpm to dry the coating film. The mandrel and the coating film were then heated at 450° C. for 20 minutes to convert the polyamic acid to polyimide. The heat-generation layer was thereby formed on the circumferential surface of the mandrel.

Example 1

"ECA-19" manufactured by CEMEDINE Co., Ltd. was applied on opposite edges of the heat-generation layer at a width of 25 mm. "ECA-19" is an electroconductive adhesive containing a modified silicone resin (crosslinkable silyl group-containing acrylic polymer) as the matrix of the adhesive and a silver filler as the electroconductive filler. Next, a ring (nickel electrode) having an outer diameter of 30.4 mm formed of a thin plate of nickel having a thickness of 80 μm and a width of 25 mm was fitted on the parts of the heat-generation layer coated with the electroconductive adhesive 1, and after allowing the coated mandrel to stand at 20° C. for 24 hours, the metal electrodes were bonded at opposite ends of the heat-generation layer. The mandrel was then removed to obtain the heat-generation belt 1.

Example 2

Heat-generation belt 2 was prepared by repeating the procedure of the production process of heat-generation belt 1 except that "Aremco-Bond 556" manufactured by AREMCO was used for the electroconductive adhesive, and the coated mandrel was allowed to stand at 100° C. for 2 hours. "Aremco-Bond 556" is an electroconductive adhesive containing a novolac epoxy resin as the adhesive matrix and a silver filler as the electroconductive filler.

Example 3

Heat-generation belt 3 was prepared by repeating the procedure of the production process of heat-generation belt 1 except that "DBC 130SD" manufactured by Panasonic was used for the electroconductive adhesive, and the coated mandrel was left at 180° C. for 0.5 hours. "DBC130SD" is an electroconductive adhesive containing a bisphenol epoxy resin as the adhesive matrix and a silver filler as the electroconductive filler.

Example 4

Heat-generation belt 4 was prepared by repeating the procedure of the production process of heat-generation belt 1 except that "CT262K" manufactured by KYOCERA Chemical Corporation was used for the electroconductive adhesive and the coated mandrel was allowed to stand at 150° C. for 1 hour. "CT262K" is an electroconductive adhesive containing glycidyl amine epoxy resin as the adhesive matrix and a silver filler as the electroconductive filler.

Comparative Example 1

Heat-generation belt 5 was prepared by repeating the procedure of the production process of heat-generation belt 1 except that "SAP15" manufactured by Sanwa Kagaku Corp was used for the electroconductive adhesive and the coated mandrel was allowed to stand at 200° C. for 1 hour. "SAP15" is an electroconductive adhesive containing a polyimide resin as the adhesive matrix and a silver filler as the electroconductive filler.

Comparative Example 2

Heat-generation belt 6 was prepared by repeating the procedure of the production process of heat-generation belt 1 except that "TB3351C" manufactured by Three Bond Co., Ltd. was used for the electroconductive adhesive, and the coated mandrel was allowed to stand at 80° C. for 1 hour. "TB3351C" is an electroconductive adhesive containing an acrylic resin as the adhesive matrix and a nickel filler as the electroconductive filler.

[Evaluations]

(1) Electroconductivity

Figure 7:
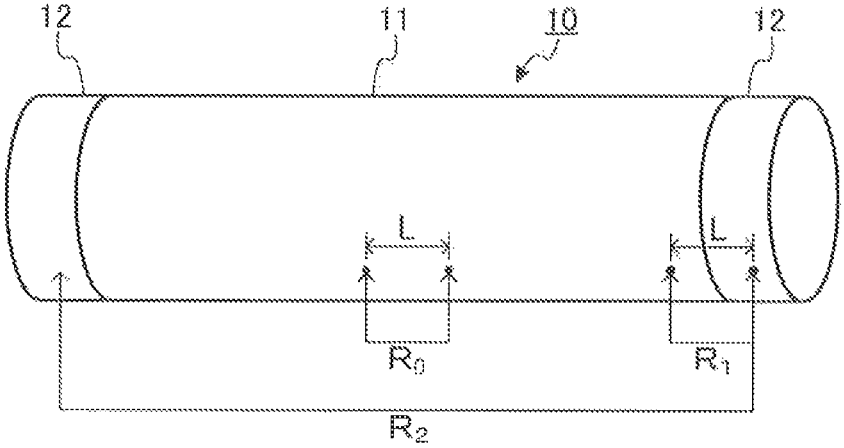
FIG. 7 is an illustration for explaining the measurement of the electric resistance in Examples.

Using a tester (circuit tester) (see FIG. 7), the heat-generation belts 1 to 6 were measured for electric resistance $R_0$ (Ω) of the heat-generation layer at distance L and electric resistance $R_1$ (Ω) between the nickel electrode and the heat-generation layer at distance L. The measurements were evaluated based on the following criteria.

A: $R_1$ is sufficiently lower than $R_0$ ($R_0/R_1 \geq 10^2$)

B: $R_1$ is lower than $R_0$ ($10 \leq R_0/R_1 < 10^2$)

C: $R_1$ is comparable to $R_0$ ($R_0/R_1 < 10$)

(2) Adhesion (Durability)

Figure 8:
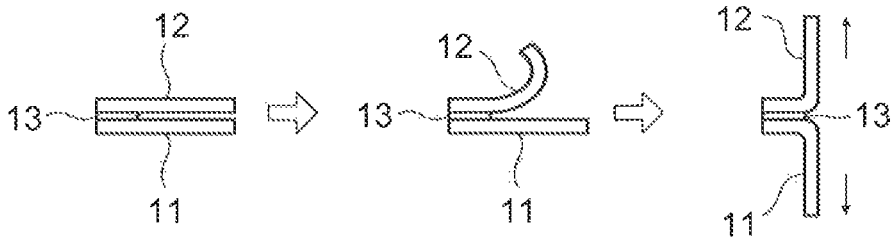
FIG. 8 is an illustration for explaining a 180° tensile tear test in Examples.

The heat-generation layer and the nickel electrode were bonded together with the electroconductive adhesives 1 to 6 to produce samples 1 to 6. In each of the samples 1 to 6, a 180° tensile tear test was conducted by pulling both of the heat-generation layer and the nickel electrode in opposite directions (see FIG. 8). The results were evaluated by the following criteria.

A: Elongation of electroconductive adhesive

B: Tearing of the electroconductive adhesive without peeling (cohesive failure)

C: Peeling of the electroconductive adhesive (interfacial peeling)

D: No adhesion (3) Heat Resistance

Separately prepared samples 1 to 6 were heated to 180° C. in an oven, and subjected to 180° tensile tear test. The results were evaluated based on the same criteria as the "(2) Adhesion".

(4) Resistance Change

Each of the heat-generation belts 1 to 6 was installed in the image forming apparatus (bizhub C550 manufactured by Konica Minolta Business Solutions Japan Co., Ltd., converted) shown in FIG. 6. Fixing (repeated heat generation of the heat-generation belt and rotation of the heat-generation belt) corresponding to the printing of 900,000 sheets of an image having a coverage of 5% was conducted except that the nip was not formed (namely, except that the heat-generation belt was not pushed by the pressing roller). This test is referred to as "durability test 1". Electric resistance $R_2$ (Ω) between the nickel electrodes of each of the heat-generation belts 1 to 6 was measured using an LCR meter before and after the durability test 1 (see FIG. 7). % Change in the electric resistance $R_2$ (Ω) before and after the durability test was calculated from the measurements and evaluated based on the following criteria:

A: $\{|R_2 \text{ (after durability test)} - R_2 \text{ (before durability test)}|/R_2 \text{ (before durability test)}\} \times 100 < 0.8$ B: $0.8 \leq \{|R_2 \text{ (after durability test)} - R_2 \text{ (before durability test)}|/R_2 \text{ (before durability test)}\} \times 100 < 1$ C: $1 \leq \{|R_2 \text{ (after durability test)} - R_2 \text{ (before durability test)}|/R_2 \text{ (before durability test)}\} \times 100 < 2$ D: $\{|R_2 \text{ (after durability test)} - R_2 \text{ (before durability test)}|/R_2 \text{ (before durability test)}\} \times 100 \geq 2$ The procedure of durability test 1 was repeated except that a nip was formed. This test is referred to as "durability test 2". In the durability test 2, an elastic fixing roller was used. As shown in FIG. 5A, a nip is formed by the deformation (recessing) of the fixing roller and the heat-generation belt. Electric resistance $R_2$ (Ω) between the nickel electrodes of each of heat-generation belts 1 to 6 was measured using the LCR meter before and after the durability test 2 (see FIG. 7). The measurements were evaluated based on the following criteria.

A: $\{|R_2 \text{ (after durability test)} - R_2 \text{ (before durability test)}|/R_2 \text{ (before durability test)}\} \times 100 < 0.8$ B: $0.8 \leq \{|(R_2 \text{ (after durability test)} - R_2 \text{ (before durability test)}|/R_2 \text{ (before durability test)}\} \times 100 < 1$ C: $1 \leq \{|R_2 \text{ (after durability test)} - R_2 \text{ (before durability test)}|/R_2 \text{ (before durability test)}\} \times 100 < 2$ D: $\{|R_2 \text{ (after durability test)} - R_2 \text{ (before durability test)}|/R_2 \text{ (before durability test)}\} \times 100 \geq 2$ The results of the evaluation are shown in Table 1.

TABLE 1

| | Hest Generation belt | Electro-conductive adhesive | Electro-conductivity | Adhesion | Heat resistance | Change in resistance Durability test 1 | Change in resistance Durability test 2 |
|---|---|---|---|---|---|---|---|
| Ex. 1 | 1 | 1 | A | A | A | A | A |
| Ex. 2 | 2 | 2 | B | B | B | A | B |
| Ex. 3 | 3 | 3 | B | B | C | B | C |
| Ex. 4 | 4 | 4 | B | C | C | B | C |
| Comp. Ex. 1 | 5 | 5 | C | D | C | D | D |
| Comp. Ex. 2 | 6 | 6 | B | B | D | D | D |

Heat-generation belts 1 to 4 exhibited high electroconductivity, adhesion, and heat resistance. Heat-generation belts 1 to 4 also exhibited extremely small changes in electric resistance before and after the durability test 1 of less than 1%, and changes in electric resistance before and after the durability test 2 of less than 2%. These results demonstrate the stable and sufficient long term adhesion between the metal electrodes and the heat-generation layer of heat-generation belts 1 to 4.

Heat-generation belt 1 exhibited particularly small change of the electric resistance of less than 0.8% in both the durability tests 1 and 2. Heat-generation belt 1 also exhibited stable and sufficient long term adhesion between the metal electrodes and the heat-generation layer in the situation involving deformation of the adhesive layer.

The heat-generation belt according to the present invention has excellent durability and heat resistance, and also, excellent long-term adhesion stability. Accordingly, it can be used as a belt-heating fixing device in an image forming apparatus, enabling further power saving as well as further improvements of the image forming apparatus.

What is claimed is:

1. An endless heat-generation belt comprising:

a heat-generation layer composed of an electroconductive resin composition, the heat-generation layer configured to generate heat when electricity is supplied to the heat-generation layer; and a pair of metal electrodes bonded to the heat-generation layer with an electroconductive adhesive, wherein the electroconductive resin composition contains a polyimide, the electroconductive adhesive contains an adhesive matrix and an electroconductive filler, the adhesive matrix comprises a modified silicone resin, and the modified silicone resin is a crosslinkable silyl group-containing organic polymer or a crosslinkable silyl group-containing acryl polymer.

2. The heat-generation belt according to claim 1, wherein the electroconductive adhesive further contains a polymer powder.

3. The heat-generation belt according to claim 1, wherein the electroconductive filler is composed of silver, nickel, or stainless steel.

4. The heat-generation belt according to claim 1, wherein each of the metal electrodes is composed of stainless steel, nickel, or iron chromium.

5. The heat-generation belt according to claim 1, wherein a resistance change between the metal electrodes is up to 1%.

6. The heat-generation belt according to claim 1, wherein the electroconductive resin composition contains the polyimide and a stainless steel fiber.

7. A fixing device comprising:

the endless heat-generation belt according to claim 1;

a fixing roller provided on an inner side of the heat-generation belt, the fixing roller being in contact with an inner circumferential surface of the heat-generation belt at one circumferential portion of the heat-generation belt;

a pressing roller disposed to face the fixing roller across the heat-generation belt, the pressing roller being configured to push an outer circumferential surface of the heat-generation belt toward the fixing roller at a circumferential surface of the pressing roller; and a power supply device configured to supply electricity to the heat-generation belt.

8. An image forming apparatus comprising:

the fixing device according to claim 7 for fixing a non-fixed toner image electrophotographically formed on a toner receiving article to the toner receiving article through the application of heat and pressure.

* * * * *